US005868180A

United States Patent [19]

Hendrickson

[11] Patent Number: 5,868,180

[45] Date of Patent: Feb. 9, 1999

[54] CONCRETE FORM SPLASH FUNNEL

[76] Inventor: John Hendrickson, 2313 N. 29th St., Tacoma, Wash. 98403

[21] Appl. No.: 456,692

[22] Filed: Jun. 1, 1995

Related U.S. Application Data

[63] Continuation-in-part of Ser. No. 16,831, Dec. 27, 1993, Pat. No. Des. 363,943.

[51] Int. Cl.[6] ..... B65B 1/04

[52] U.S. Cl. ..... 141/331; 141/340

[58] Field of Search ..... 141/331–343, 141/369, 370, 391; 52/127.3, 127.4, DIG. 1, 749.13, 750, 742.1, 742.13, 742.14, 742.16

[56] References Cited

U.S. PATENT DOCUMENTS

| | | | |
|---|---|---|---|
| 418,719 | 1/1890 | Hepburn | 141/341 |
| 657,080 | 9/1900 | Belden | 141/331 |
| 1,219,272 | 3/1917 | Edison | 52/742.14 |
| 2,688,429 | 9/1954 | Davison | 141/365 |
| 2,827,931 | 3/1958 | Melvin | 141/331 |
| 2,940,298 | 6/1960 | Joseph | 72/128 |

*Primary Examiner*—Steven O. Douglas
*Attorney, Agent, or Firm*—Thomas W. Secrest

[57] ABSTRACT

There is provided a low cost funnel for directing the flow of fluid concrete to the form for a concrete wall or a concrete block wall. The funnel can be unitary and of plastic. Further, the funnels can be nested with each other for ease of storage and cost of transportation.

18 Claims, 10 Drawing Sheets

CONCRETE FORM SPLASH FUNNEL

CROSS-REFERENCES TO RELATED PATENT APPLICATIONS (IF ANY)

There is a design patent application Ser. No. 29/016,831, filing date of 1993 Dec. 27 entitled, "CONCRETE FORM SPLASH FUNNEL."

There was a design patent application Ser. No. 07/710,940 filing date of 1991 Jun. 6, entitled, "A FUNNEL FOR DIRECTING THE FLOW OF FLUID CONCRETE", now abandoned.

The known prior art is listed as follows by patentee, Ser. No. and issuing date:

| PATENTEE | PATENT NUMBER | ISSUING DATE |
|---|---|---|
| MACKISSIC | D234,815 | 4/8/1975 |
| GIBBONS | D260,651 | 9/8/1981 |
| HOWARD ET AL | D300,636 | 4/11/1989 |
| LYSNE | 2,793,788 | 5/28/1957 |
| SCHMEDNECHT | 4,125,332 | 11/14/1978 |
| BLADYKAS | 4,236,675 | 12/2/1980 |
| SANZONE | 4,813,818 | 3/21/1989 |
| WADDINGTON | 3,416,204 | 12/17/1968 |
| SCHIFFELBEIN | 4,007,821 | 2/15/1977 |
| HALL | 4,075,711 | 2/21/1978 |
| CLACKE | 1,224,277 | 5/1917 |
| BLAIR | 984,531 | 2/1911 |
| BESSETT ET AL | 2,844,337 | 10/1974 |
| MATSUI | 4,225,269 | 9/1980 |
| STEES | 4,258,892 | 3/1981 |
| ABONNEC (FRANCE) | 1,124,755 | 10/17/1956 |
| MARKHAM (EPO) | 0,124,435 | 11/1984 |
| JAPAN | 1,010,418 | 1/1986 |

There is being filed with the filing of this utility patent application, a design patent application entitled "A CONCRETE FORM SPLASH FUNNEL", Ser. No. 29/039,667, filing date 1995 Jun. 1, now U.S. Pat. No. D370,921 with issuing date of 1996 Jun. 18.

This utility patent application is a continuation-in-part of co-pending design patent application Ser. No. 29/016,831, filing date of 1993 Dec. 27, now U.S. Pat. No. D363,943 with an issuing date of 1995 Nov. 7.

(C) STATEMENT AS TO RIGHTS TO INVENTIONS MADE UNDER

FEDERALLY SPONSORED RESEARCH AND DEVELOPMENT (IF ANY)

This invention was made by private investment of the inventor. The inventor did not receive any federally sponsored research and development funds.

(D) BACKGROUND OF THE INVENTION

1. Field of the Invention

The inventor has worked in construction and has built forms for receiving fluid concrete in the construction of a wall. The form for a concrete wall comprises two sheets of plywood spaced-apart six inches or eight inches to designate a defined space. The forms are secured at the top and at the bottom to withstand the outward pressure of the fluid concrete.

Generally, a concrete truck having a rotating drum for the mixing of its concrete is maneuvered close to the forms. A chute on the truck is beneath the rotating drum. The end of the chute is positioned so as to direct the fluid concrete into the forms. The forms have a six-inch or eight-inch distance between them. The lip on the radius of the truck chute is twelve inches wide. Getting the chute to line up directly over the form is a constant problem. Unfortunately, some of the fluid concrete spills on the outside of the form or on the ground. This concrete is totally wasted. The concrete that falls onto the form is now dried and must be cleaned off. This adds to the cost of the project.

The inventor has worked in the Skilled Building Trades as a carpenter for 28 years. The inventor has invented a funnel to keep all of the fluid concrete on the inside of the form during the pouring of a concrete wall. The upper part of the funnel sets approximately six inches above the top of the form. The lower part of the funnel sets approximately four inches down inside the form. The workman positions the concrete truck chute so that the fluid concrete flows through the funnel and into the form. As a result, there is no spillage of fluid concrete onto the form or onto the ground.

Further, many exterior walls of commercial buildings are constructed of cement block. In the construction of cement block walls, every sixth horizontal row of cement block is called a bond beam. There is positioned in the cell of each bond beam block, a vertical rod of ⅝-inch diameter reinforcing rod. Also, there is positioned horizontally in the bond beam (half the depth down, 3½ inches) two ⅝-inch reinforcing rods that run continuous. Fluid concrete is poured into the bond beam block, filling all of the cells of the first five horizontal rows and the bond beam. This process is called "grouting the cells." The process is repeated again on the next set of six horizontal rows (called a "lift"), until the top of the wall is reached. A two-inch flexible hose runs from a concrete pump to pump the concrete to grout the cells. The concrete pump surges while pumping. This causes the hose to lurch, making it difficult for the workman to keep the fluid concrete inside the defined space of the bond beam during the pour. Concrete invariably overflows and runs down the outside of the cement block wall. As the surface of the cement block is porous, the spattered fluid concrete has a tendency to dry quickly on the wall. The dried, spattered concrete has to be cleaned off. This is a waste of labor and concrete.

This invention is directed to the following: for setting the funnel partially down inside the bond beam so that the funnel directs the flow of fluid concrete into the bond beam for the grouting of the cells. None of the concrete is wasted or spattered on the walls. The workman can direct the flexible hose so that the fluid concrete flows through the funnel and into the bond beam. The width of the target he must hit with the pump hose increases from four inches to fifteen inches in width. As a result, concrete is not wasted by being accidentally spattered on the walls with the pursuant labor to clean the wall.

2. Description of the Prior Art

The inventor has reviewed the prior art and considers that subject inventions define over the prior art. None of aforementioned teaches of or describes a funnel similar to the funnel disclosed and claimed in this patent application.

(E) SUMMARY

The "Concrete Form Splash Funnel" is essentially a funnel for directing the flow of fluid concrete into the defined space of a form. The form is two sheets of one-inch plywood spaced six or eight inches apart for the receiving of fluid concrete.

The "Bond Beam Pourer" is essentially a funnel for directing the flow of fluid concrete into bond beams when grouting the cells of a cement block wall.

The upper part of the invention receives the fluid concrete from the concrete truck chute or the pump hose. The lower part of the invention is smaller so that it can rest inside the form or inside the bond beam. In this manner, the lower part directs the flow of fluid concrete into the defined space between the forms or into the bond beam.

The materials of construction of the invention are many. The first prototype unit was made from plywood. Another way of making the invention is the use of plastic. A plastic can be molded to the desired configuration and size. A desirable plastic in this regard is high-density polyethylene. The high-density polyethylene makes a desirable material for the funnel of this invention because of its resiliency and extremely slick surface.

OBJECTS AND ADVANTAGES

An object of this invention is to provide a funnel for directing the flow of fluid concrete to a defined space such as into a form for a concrete wall or into the bond beam of a cement block wall;

Another object is to provide a funnel which saves fluid concrete as the fluid concrete flows into the defined space and not outside of the defined space;

An additional object is to provide a funnel which saves time in pouring the fluid concrete into a defined space as the funnel provides a larger target opening than usually provided by the opening to the defined space;

Another object is to provide a funnel which saves time, labor and money as less fluid concrete is spilled and therefore there is less fluid concrete to remove from the form or from the cement block wall;

A further object is to provide a funnel which can be stacked in a nesting manner with other funnels for ease of transportation and storage (uses less cubic footage);

Another object and advantage of this funnel is that the lower part of the funnel is configured so that the funnel is definitely positioned in the form and stabilizes itself (because of its angled sides) for receiving and dispensing fluid concrete into the defined space.

Additional objects, advantages and novel features of the invention will be set forth in part in the description which follows, and in part will become apparent to those skilled in the art upon examination of the following or may be learned by the practice of the invention. The objects and advantages of the invention may be realized and attained by means of the instrumentalities and combinations particularly pointed out in the appended claims.

(F) BRIEF DESCRIPTION OF THE DRAWINGS

In the drawings, it is seen that

FIG. 1 is top plan view of the funnel;

FIG. 2 is a side elevational view and it is to be understood that the other side elevational view is the same;

FIG. 3 is an end elevational view and it is to be understood that the other end elevational view is the same;

FIG. 4 is a bottom plan view;

FIG. 5 is a side-elevational view of the funnel and it is to be understood that the other side-elevational view is the same;

FIG. 6 is an end elevational view and it is to be understood that the other end elevational view is the same;

FIG. 7 is a top plan view; and,

FIG. 8 is a bottom plan view;

(G) DESCRIPTION OF THE PREFERRED EMBODIMENT(S)

Figure 1:
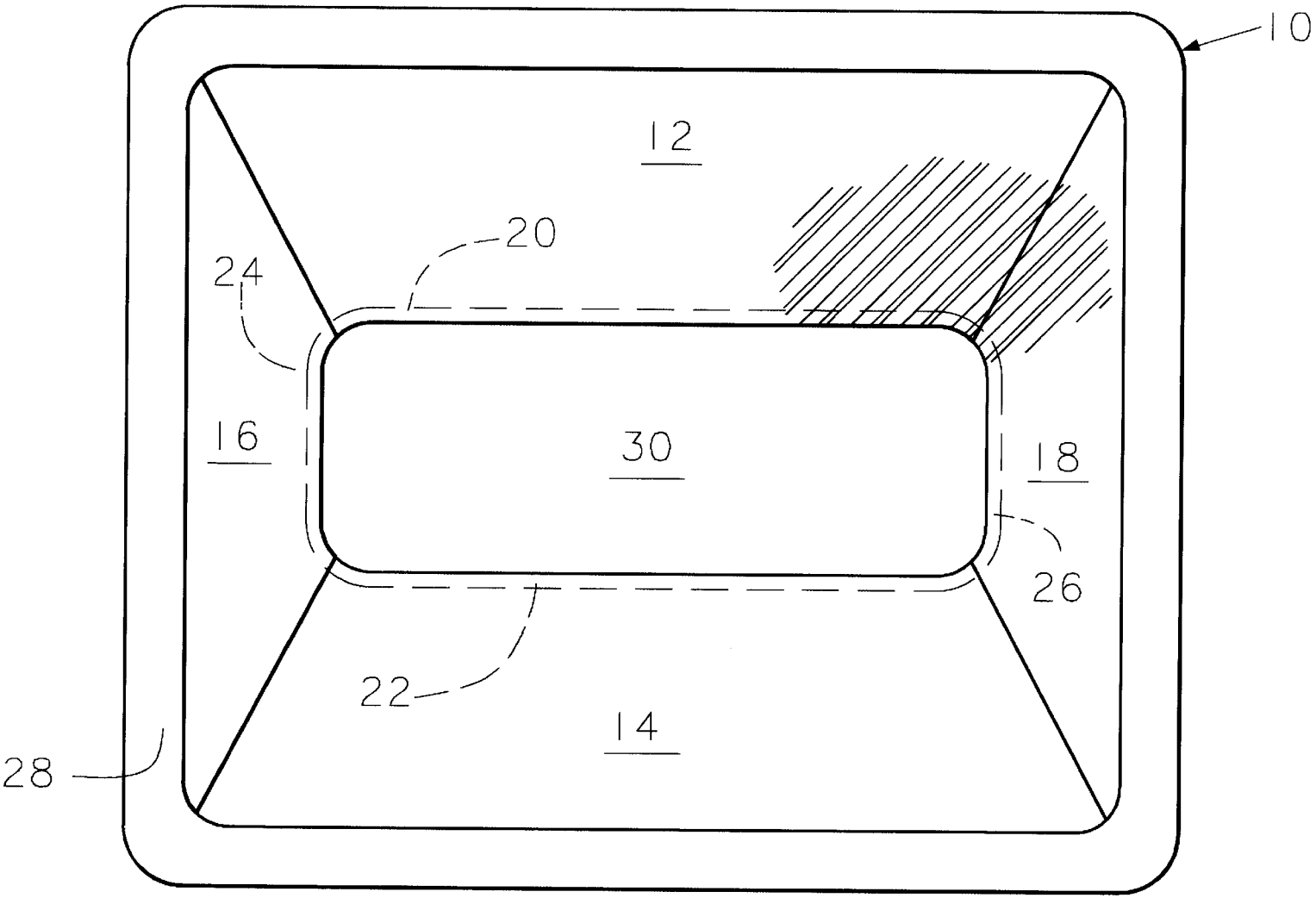
FIGS. 1–4 are directed to a first species of the funnel.
Figure 2:
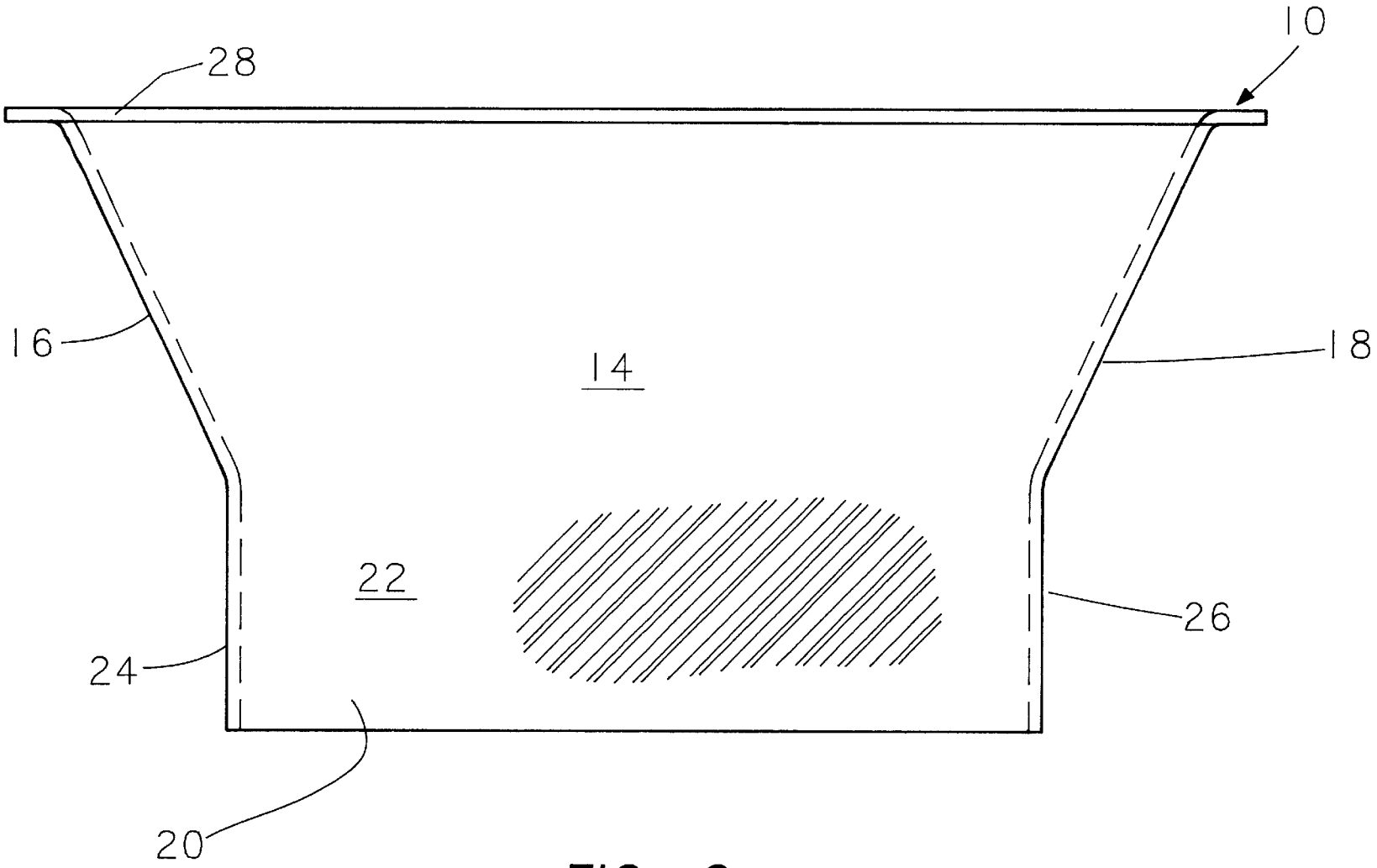
Figure 3:
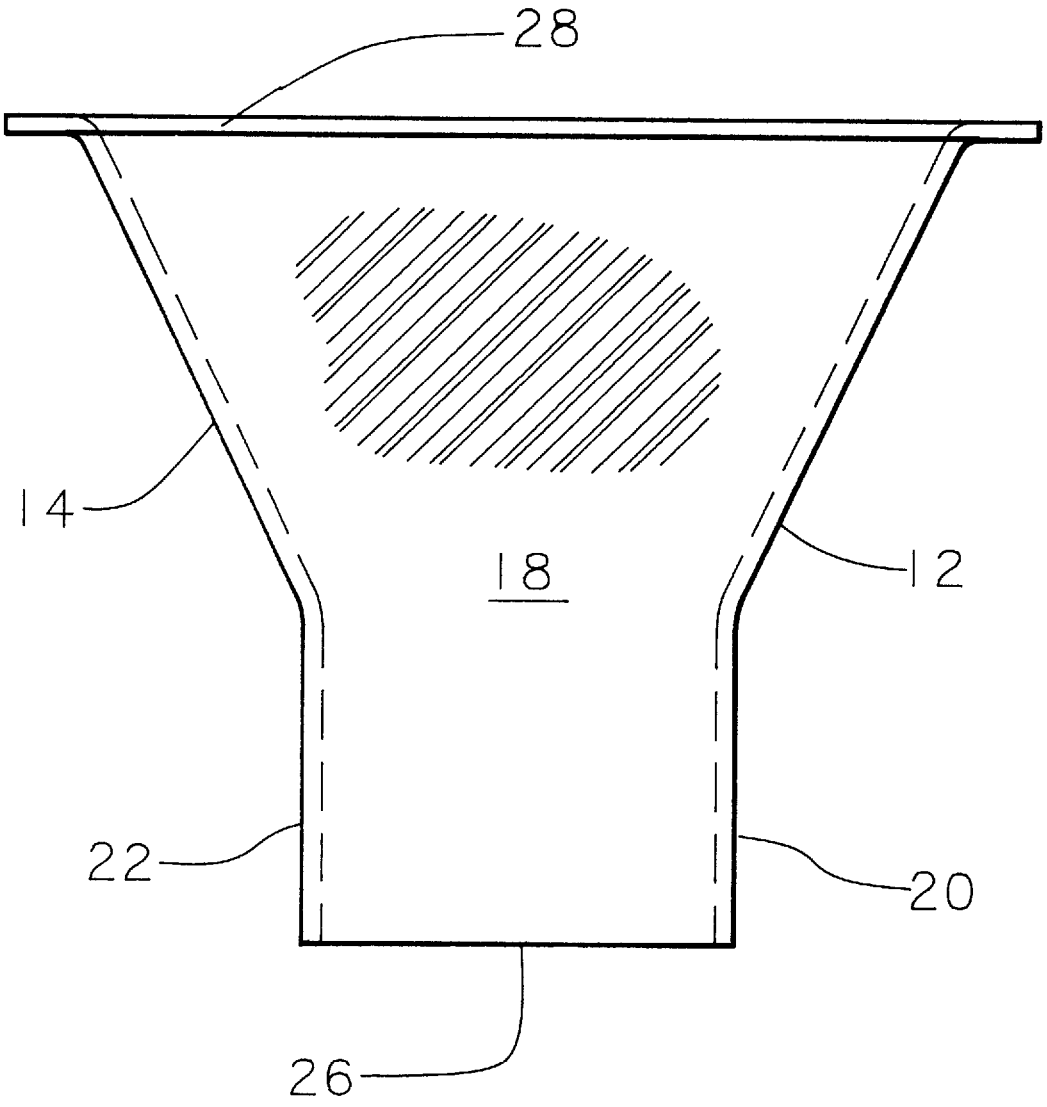
Figure 4:
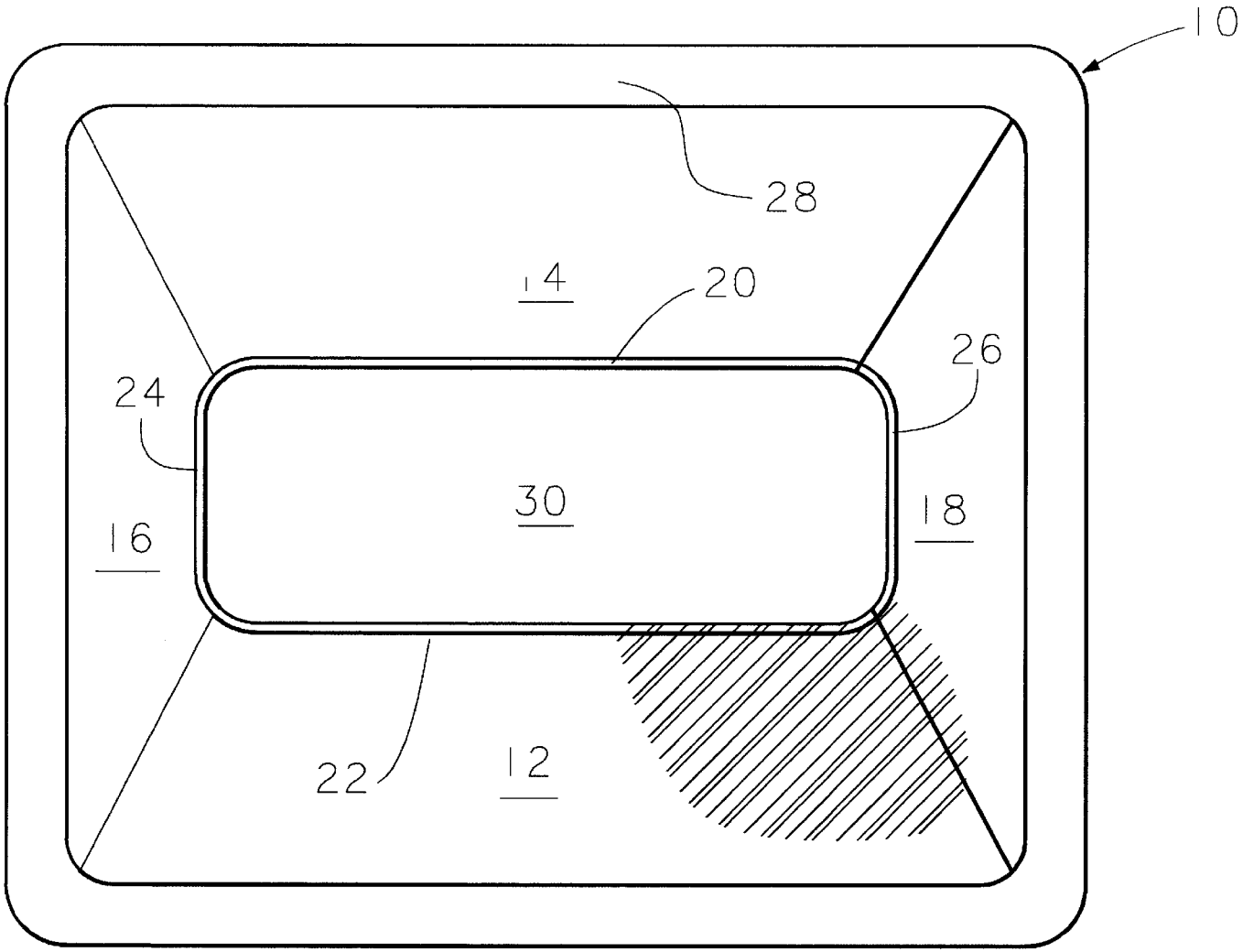

With respect to the drawings it is seen that there is a funnel 10 having spaced-apart sides 12 and 14 and spaced-apart ends 16 and 18.

The sides 12 and 14 depend downwardly into an inner downward side 20 and an inner downward side 22. The sides are spaced apart.

Also, the ends 16 and 18 depend downwardly into an inner downward end 24 and inner downward end 26. The ends are spaced apart.

The side 12 merges into the inner downward side 20.

The side 14 merges into the inner downward side 22.

The end 16 merges into the inner downward end 24.

The end 14 merges into the inner downward end 26.

A circumscribing rim 28 surrounds the upper part of the sides 12 and 14 and the ends 16 and 18.

In effect, the funnel 10 is of a one piece unitary plastic material such as high-density polyethylene. The thickness of the rim 28, the sides 12 and 14 and the ends 16 and 18, and the sides 20 and 22 and the ends 24 and 26 are approximately ¼-inch. An advantage of high density polyethylene is that cured concrete can easily be removed. Assume that there is cured concrete on the funnel. To remove the cured concrete from the funnel tap hard on the funnel. The cured concrete will break loose and can be thrown away.

The sides 20 and 22 and the ends 24 and 26 define an opening 30 through which fluid concrete can flow.

FIGS. 5–8 are directed to another species of the funnel and wherein 70 is a reference numeral for the funnel. This funnel comprises two descending inward sloping sides 72 and 74 and two descending inward sloping ends 76 and 78.

Figure 8:
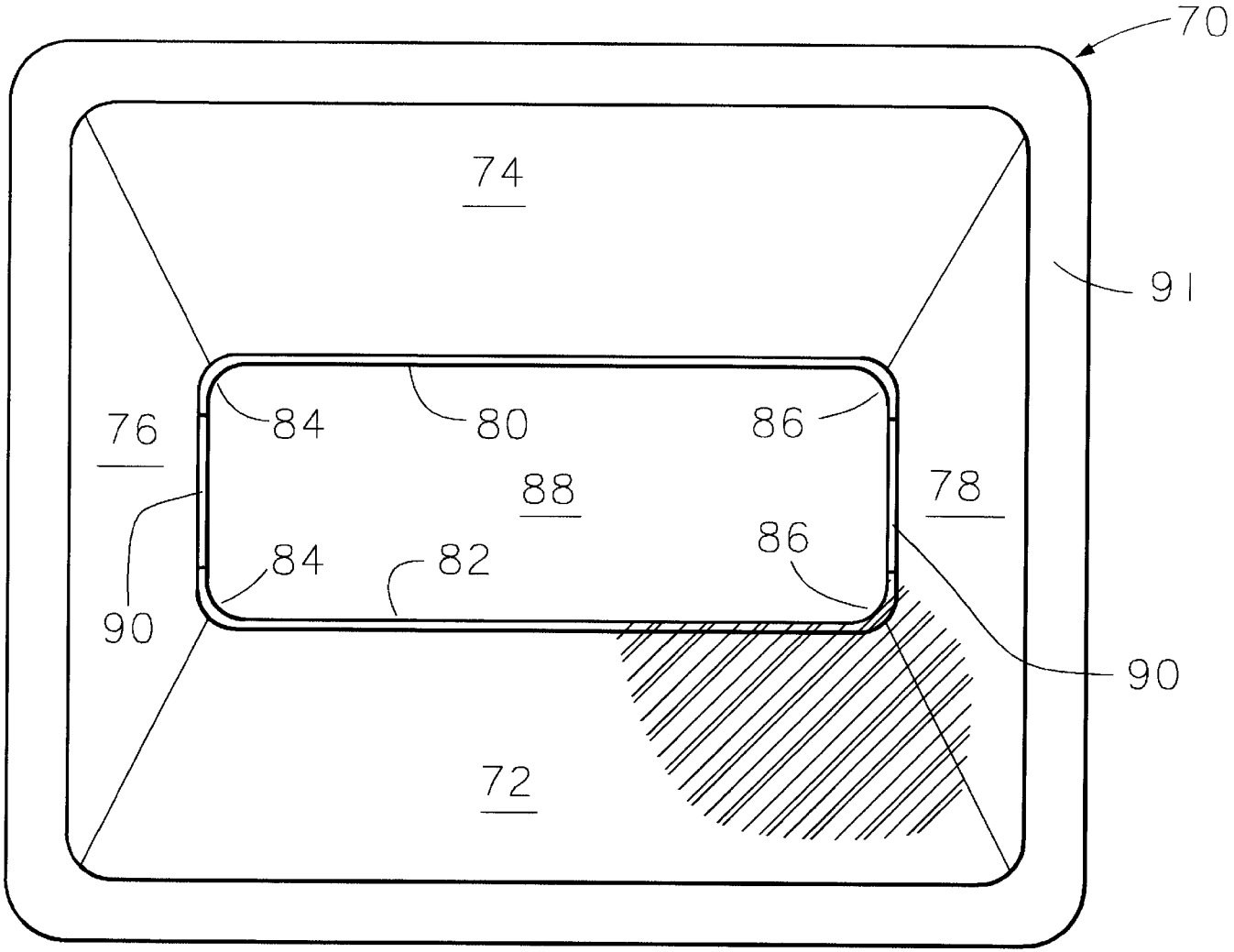

FIG. 8, above plan view of the funnel 70, is seen that there are depending sides 80 and 82 on the inward sloping sides 76 and 78. Also, there are depending ends 84 for the sloping end 76 and depending ends 86 for the sloping ends 78.

The depending sides 80 and 82 and the depending ends 84 and 86 define an opening 88 through which fluid concrete can flow.

Figure 6:
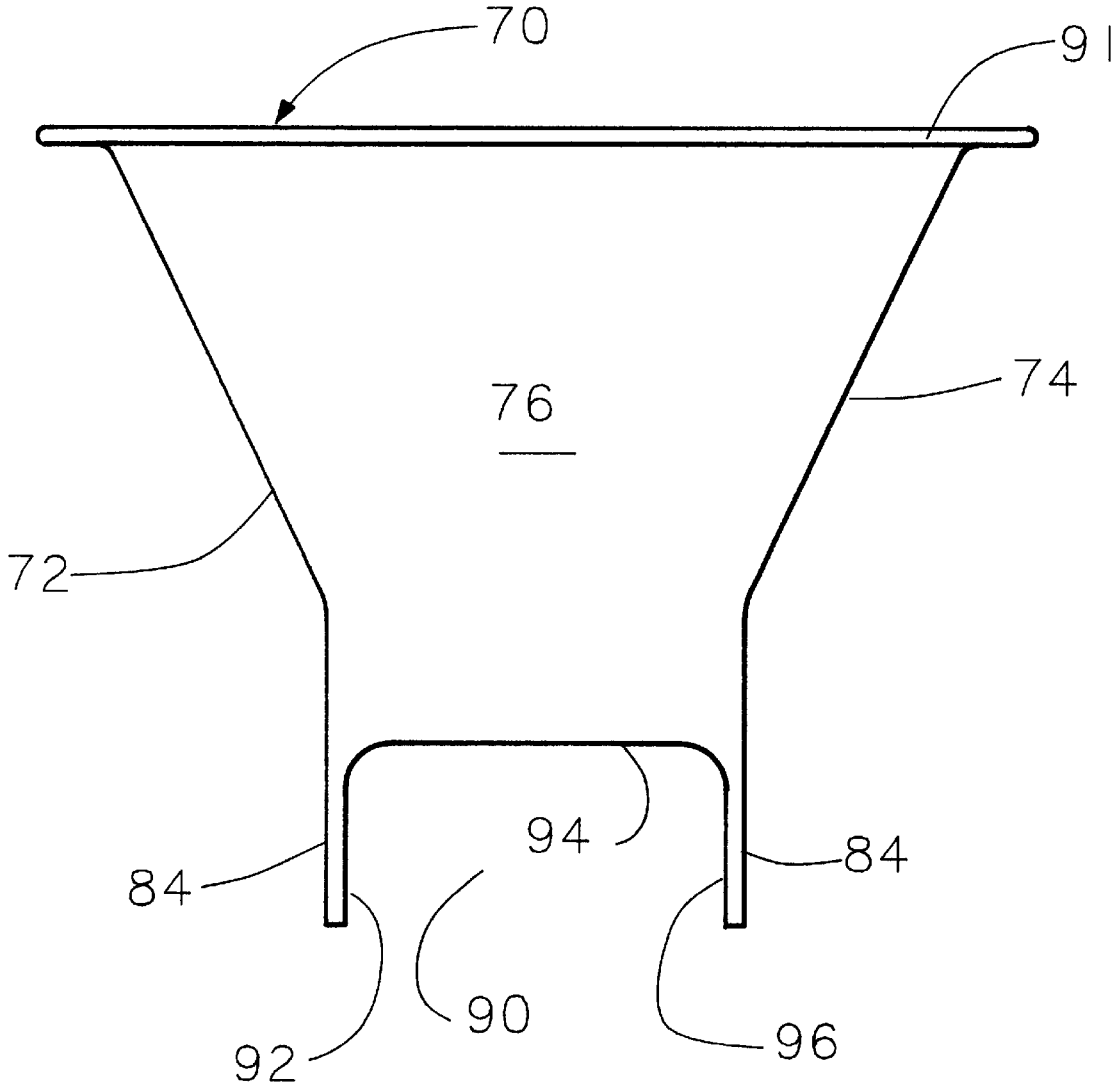
Figure 7:
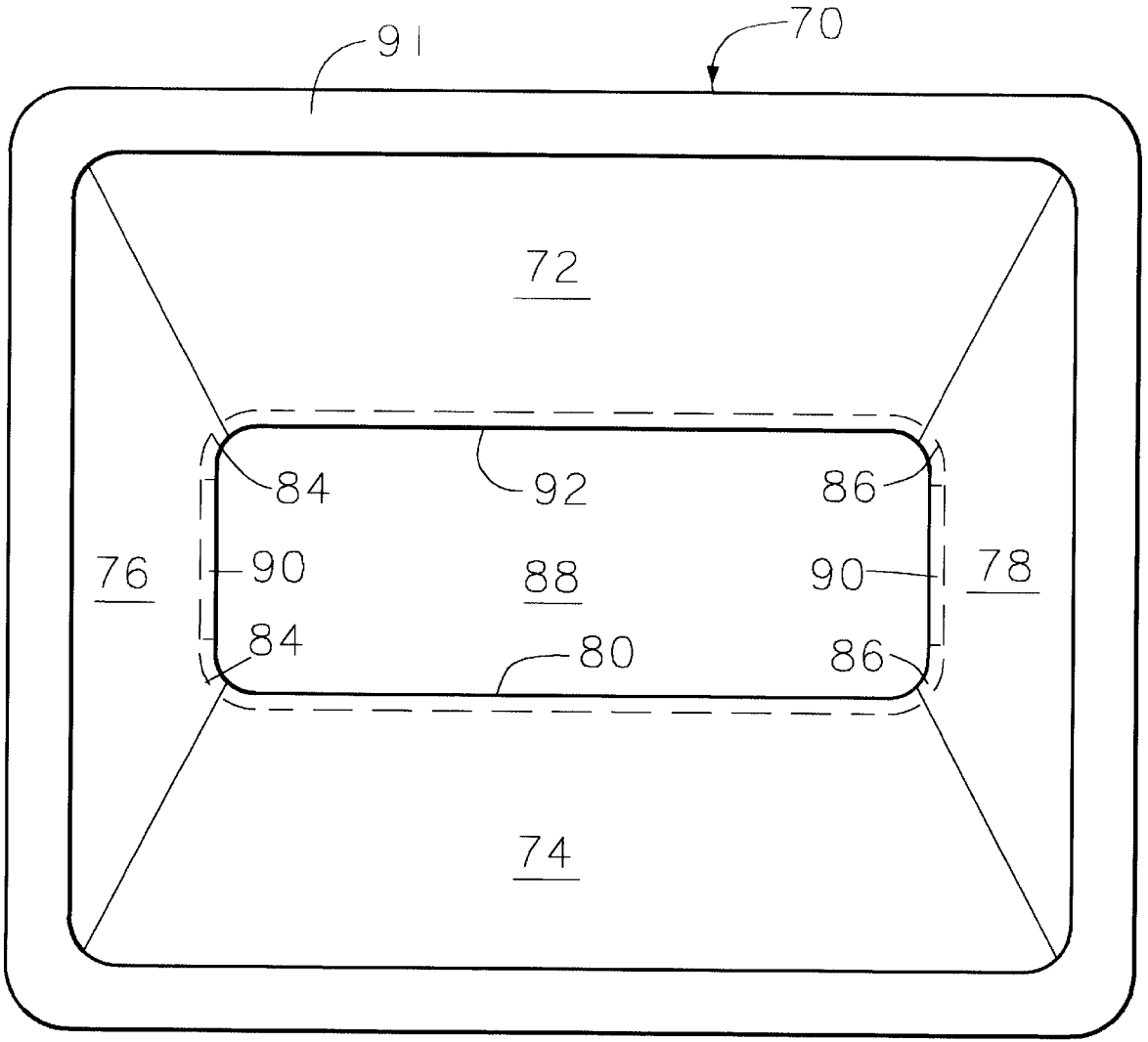

In each depending end 84 and depending end 86 there is a recess 90 defined, see FIG. 6, a side edge 92, an upper edge 94 and a side edge 96.

With the recess 90, the fluid concrete can flow downwardly and also outwardly away from the funnel 70. In other words, the distribution of the fluid concrete will be faster than with the funnel 10 of FIGS. 1–4.

The funnel 10 and 70 are very similar. The main difference being the recess 90 in the funnel 70.

With the funnel 10 the fluid concrete is directed downwardly between the depending sides 20 and 22 and the depending ends 24 and 26.

In the funnel 70, there is a recess 90 in the depending ends 84. The recess 90 allows the fluid concrete to flow downwardly between the depending sides 80 and 82 and also to outwardly in a lateral manner through the recess 90 and the depending ends 84 and 86.

Figure 9:
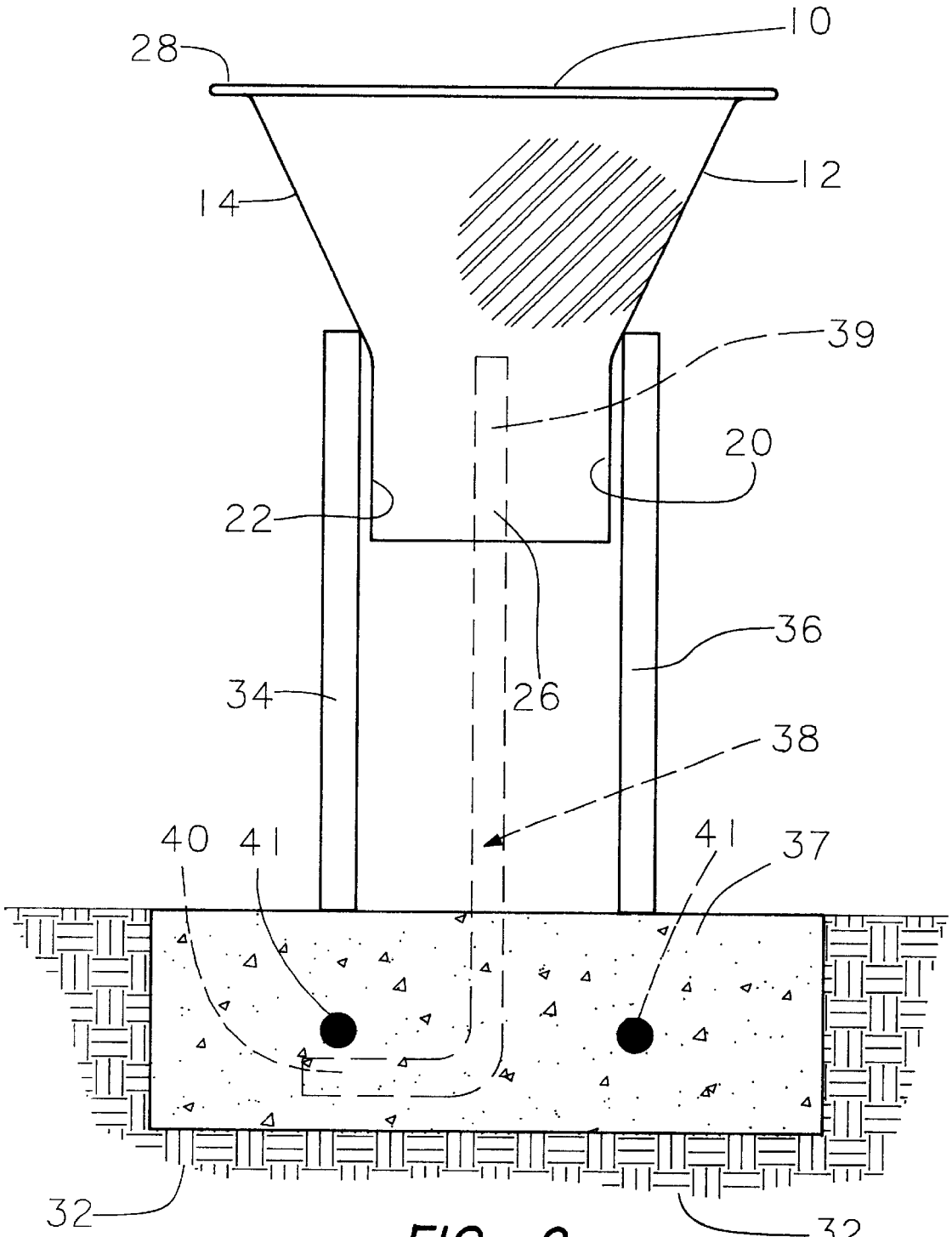
FIG. 9 is a schematic end elevational view showing the form for a concrete wall and the first species of the funnel positioned inside of the sheets of plywood; and, FIG. 10 is a section view illustrating cement blocks as used in the construction of a cement block wall with the funnel positioned on top of the bond beam block for directing fluid concrete into the defined space in the bond beam.

In FIG. 9, there is illustrated the use of the funnel 10 in the formation of a concrete wall.

There are two spaced-apart plywood forms (sheets of plywood 34 and 36) for receiving fluid concrete. Forms 34 and 36 rest on an already poured concrete footing 37. The funnel sides 12 and 14 rest on the upper inner edges of the plywood sheets 34 and 36. In that way sides 20 and 22 and the ends 24 and 26 (comprising the lower rectangular portion of the funnel defining the opening 30) are positioned between the plywood sheets 34 and 36 so as to direct the flow of fluid concrete into the defined space defined by 34 and 36.

In operation, the bottom end of the chute on the concrete truck is centered over the opening 30 and just above the rim 28. The fluid concrete flows down the sides 12 and 14 and the ends 16 and 18 to the sides 20 and 22 and the ends 24 and 26 and passes through the opening 30 to flow downwardly into the defined space between plywood sheets 34 and 36.

There is no waste of the fluid concrete as the fluid concrete is directed to the defined space between forms 34 and 36 and does not fall outside of forms 34 and 36. Therefore, there is no fluid concrete that needs to be cleaned off the outside of the forms 34 and 36.

In the concrete footing 37 there is a stub steel rod 38. Rod 38 comprises an upright member 39 which projects above the footing 37. The rod 38 on its lower end bends at a right angle into a short toe 40. The toe 40 positions the rod 38 in the footing 37. The upright member 39 assists in tying-in freshly poured uncured concrete to the footing 37.

In FIG. 6, it is seen that the footing 37 is of sufficient thickness to receive and to house the short toe 40 and two spaced-apart reinforcing rods 41.

Figure 10:
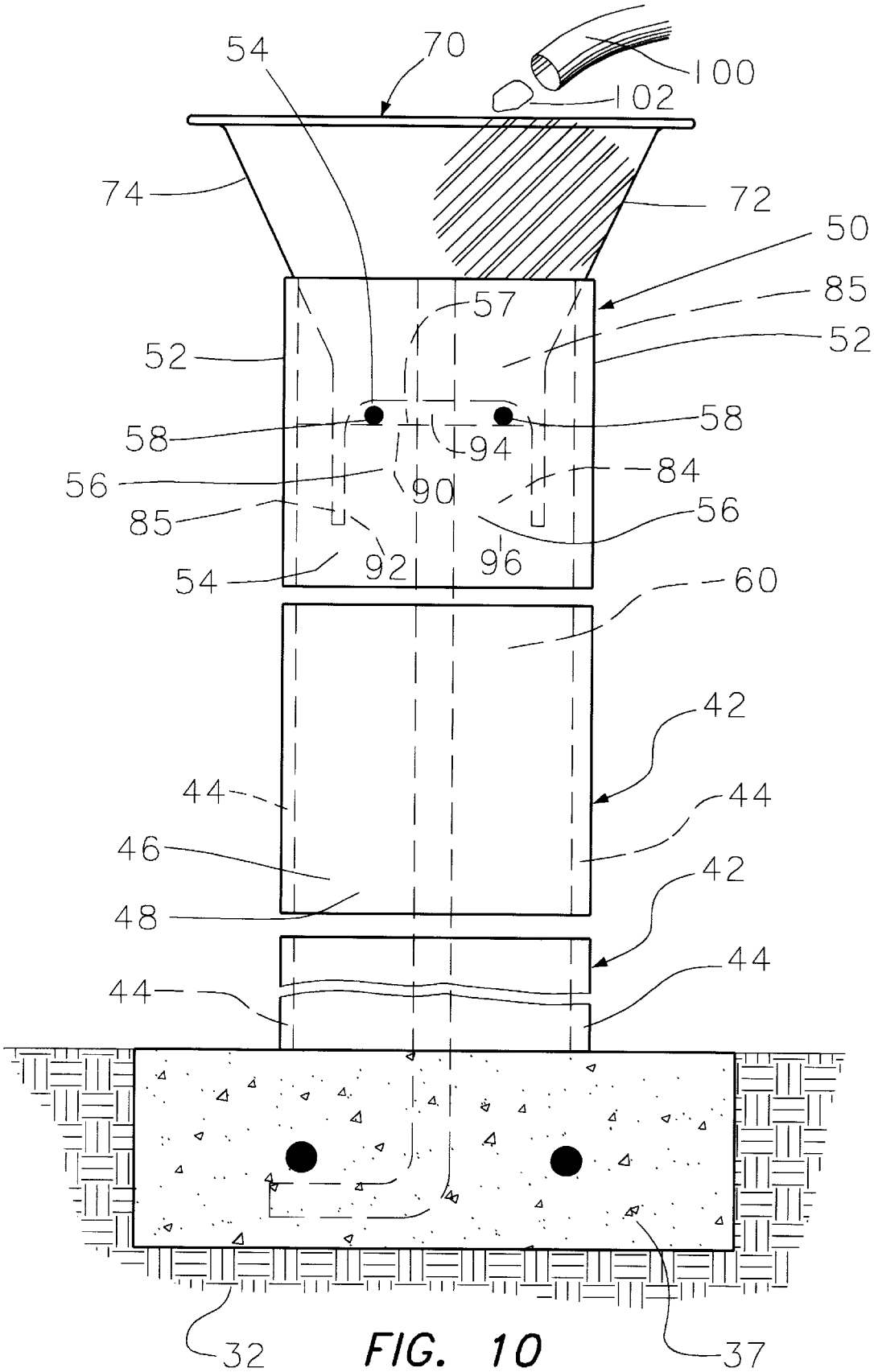

In FIG. 10, there is illustrated the pouring of a bond beam in the construction of a cement block wall.

The ground is 32 and the footing is 37. Such as a concrete footing as in FIG. 9 and positioned under and on top of the ground 32. There are five rows of cement blocks 42 positioned on the footing 37. The sixth row from the footing 37 is the bond beam block 50.

A cement block 42 has two spaced-apart side walls 44 and two spaced-apart end walls 46. At the central portion there is a cross wall 48 connecting with the two side walls 44. The block 42 is unitary.

A bond beam block 50 has two spaced-apart side walls 52 and two spaced-apart end walls 54. There is a cross wall 56 connecting with the side walls 52 at the central part. The block 50 is unitary.

The walls 54 and 56 are one-half the height of the side walls 52, see FIG. 10, and have an upper surface 57.

There is laid on the upper surface 57 and on top of the walls 54 and 56 two spaced-apart ⅝-inch reinforcing rods 58. The rods 58 are positioned horizontally.

The reader is to understand that the cement block 42 (typical for the first five courses of cement block) and a typical bond beam 50 have hollow interiors for receiving fluid concrete.

There is used with the bond beam block 50 the funnel 70.

The funnel 70 can be positioned so that the depending sides 80 and 82 and the depending ends 84 and 86 are between the interior surfaces of the spaced-apart side walls 52 and in the defined space in the bond beam block 50. The lower outer surfaces of the downwardly and inwardly sloping sides 72 and 74 rest on the upper inner edges of the exterior walls or side walls 52 of the beam block 50.

Fluid concrete 100 can be directed to the funnel 70. There is a concrete pump truck and a hose 100 connecting with the concrete truck. A pump pumps the fluid concrete 102 through the hose 100 and into the funnel 70 and between the depending sides 80 and 82 and the depending ends 84 and 86. The fluid concrete 102 flows downwardly on the inside surfaces of these sides and ends and through the opening 88 and into the hollow interior 60 of the blocks. In time, the fluid concrete cures and there is a rigid block wall reinforced by the horizontal reinforcing rods 58 and the vertical reinforcing rods 52.

In FIG. 10, it is seen that the construction worker can direct the output of the concrete hose 100 for directing the fluid concrete into the funnel 70. There is no spillage of the fluid concrete 100 onto the walls or the ground and there is no concrete to clean off the walls. Also, there is no waste of the concrete as the concrete flows into the funnel 70 and is directed to the defined space or the hollow interior 60 of the cement blocks.

The interior spacing between the plywood sheets 34 and 36 may vary. Some concrete walls are six inches in thickness. Other concrete walls are eight inches in thickness.

The funnel 10 is of such a dimension that the depending sides 20 and 22 are positioned between the plywood sheets 34 and 36. In fact, the sides 20 and 22 depend into the defined space between the plywood sheets 34 and 36. The length of the sides 20 and 22 can be two inches. This means that the depending sides 20 and 22 and the depending ends 24 and 26 can depend approximately two inches into the defined space between the plywood sheets 34 and 36. The length of the depending sides 20 and 22 and the depending ends 24 and 26 can vary depending on the desired use.

In FIG. 9, it is seen that the inwardly sloping sides 12 and 14 of the funnel 10 rest on the upper inside edges of the plywood sheets 34 and 36 so as to assist in positioning the funnel 10 with respect to the plywood sheets 34 and 36.

In FIG. 10, the sloping sides 72 and 74 are positioned between the upper inside edges of the spaced-apart side walls 52 of the bond beam block 50. The depending sides 80 and 82 are approximately two inches in length and the lower part of the funnel 10 rests in between the spaced-apart walls 52 and 56 approximately two inches. The inwardly sloping sides 12 and 14 rest on the upper interior edge of the exterior walls of the spaced-apart walls 52.

The funnels 10 and 70 may be made in different sizes to accommodate different distances between the plywood sheets 34 and 36 and also between the exterior walls 54 and 56 of the beam block 50.

From the foregoing, it is seen that I have provided a funnel for directing the flow of fluid concrete to a defined space such as into a form for a concrete wall or into a bond beam in the construction of a cement block wall. The funnel saves fluid concrete as the funnel directs the flow of the fluid concrete into the defined space. Further, the funnel saves time in pouring the fluid concrete into the defined space as the funnel provides a larger target opening than is usually provided by the opening to the defined space. The opening to the defined space may be six to eight inches in width. To direct the fluid concrete into such a narrow opening requires more time and also results in the waste of spilled fluid concrete. Instead of an opening of six inches, the funnel provides an opening 12 to 15 inches. Further, there is a saving in time, labor and money as less fluid concrete is spilled and therefore there is less spilled concrete to remove from the form for the concrete wall or from the cement block wall.

The lower part of the funnel and, in particular, sides 20 and 22 and ends 24 and 26 fit between the forms 34 and 36 without being able to rotate, but being able to move slightly, or to fit between the exterior walls 54 and 56, without being able to rotate, but being able to move slightly. This configuration of the sides 20 and 22 and ends 24 and 26 stabilizes the funnel 10 for receiving and for dispersing fluid concrete to the defined space between the forms 34 and 36 or the walls 54 and 56 in the concrete block.

Figure 5:
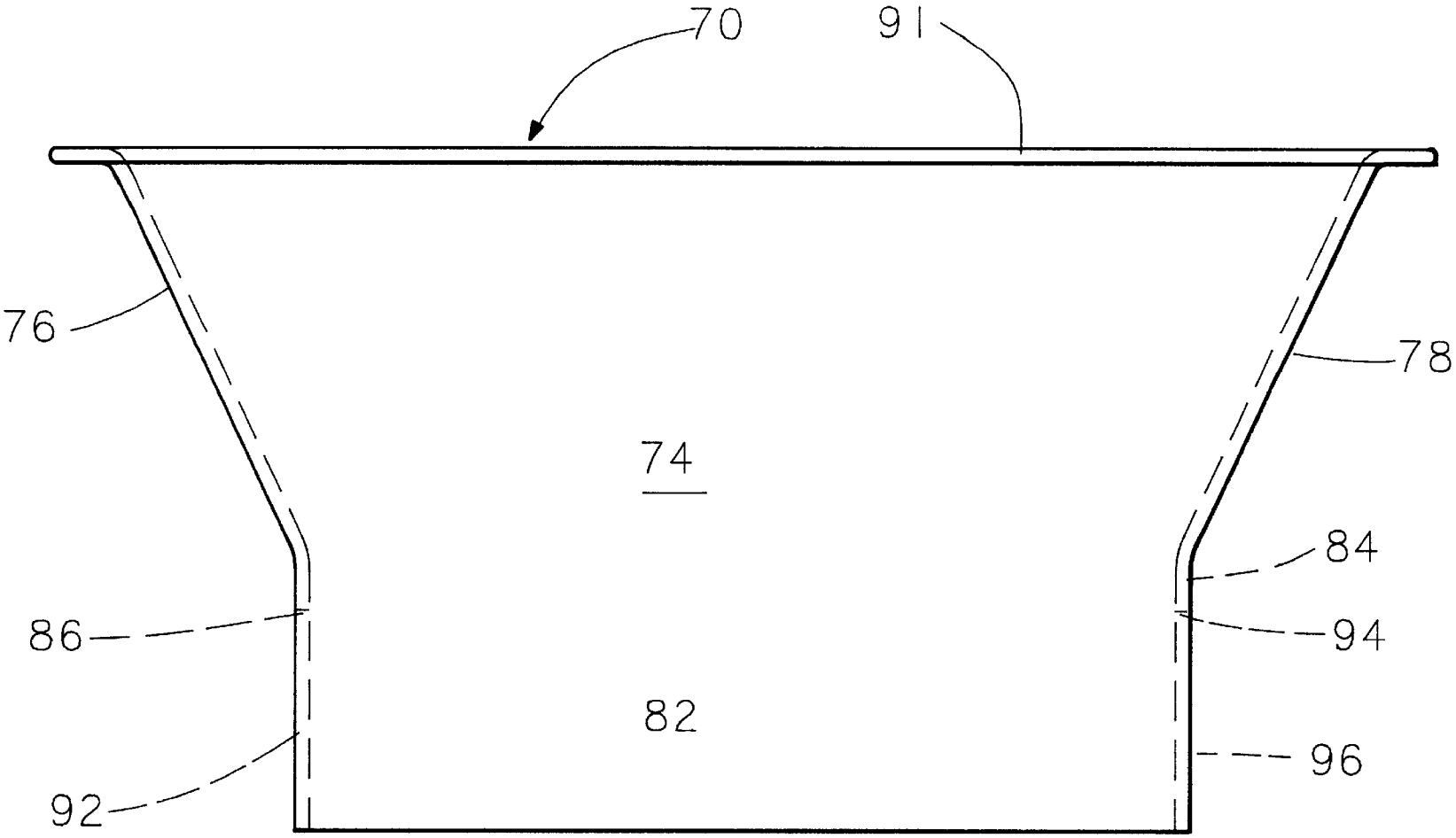
FIGS. 5–8 are directed to a second species of the funnel.

In FIG. 5, it is seen that the sides 20 and 22 and ends 24 and 26 are in a rectangular configuration. It is also possible for the sides 20 and 22 and ends 24 and 26 to be in a square configuration. There is a slight distance between the sides 20 and 22 and the forms 34 and 36 or the exterior wall 54 and 56. This makes it possible to easily position the funnel 10 between the forms 34 and 36 or the exterior walls 54 and 56. However, it is not possible to rotate the funnel between the forms 34 and 36 or between the exterior walls 54 and 56. Therefore, the funnel is stabilized in its position with respect to the forms 34 and 36 or the exteriors walls 54 and 56. The stabilization of the funnel 10 makes it possible for the funnel 10 to receive and to disperse fluid concrete.

A funnel for directing the flow of fluid material to a defined space, said funnel comprising first walls defining a first opening; said first walls flaring outwardly into second walls to define a second opening; said second opening being larger than said first opening; said first walls comprising a first side, a second side, a first end and a second end; said first side and said second side being substantially parallel; said first end and said second end being substantially parallel; said first side and said first end being substantially at right angles to each other; said first side and said first end being united with each other; said first end and said second side being substantially at right angles to each other; said first end and said second side being united with each other; said second side and said second end being substantially at right angles to each other; said second side and said second end being united with each other; said second end and said first side being substantially at right angles to each other; said second end and said first side being united with each other; said first side flaring outwardly into said first sloping side; said first end flaring outwardly into said first sloping end; said first sloping side and said first sloping end uniting with each other; said second side flaring outwardly into said second sloping side; said first sloping end and said second sloping side uniting with each other; said second end flaring outwardly into said second sloping end; said second sloping side and said second sloping end uniting with each other; said second sloping end and said first sloping side uniting with each other; a rim on the outer part of said first sloping side, said first sloping end, said second sloping side and said second sloping end; said funnel being of a unitary, one-piece continuous construction; said rim being directed outwardly from said sloping sides and said sloping ends; said first walls being directed away from said second walls; said first side and said second side being longer than said first end and said second end; said first sloping side and said second sloping side being longer than said first sloping end and said second sloping end; the outer part of said first sloping side and said second sloping side being longer than said first side and said second side; the outer part of said first sloping end and said second sloping end being longer than said first end and said second end.

A process for making a funnel for directing the flow of a fluid material to a defined space, said process comprising forming first walls to define a first opening; flaring said first walls outwardly to form second walls to define a second opening; forming said second opening to be larger than said first opening; forming said first walls into a first side, a second side, a first end and a second end; forming said first side and said second side to be substantially parallel; forming said first end and said second end to be substantially parallel; forming said first side and said first end to be substantially at right angles to each other; uniting said first side and said first end; forming said first end and said second side to be substantially at right angles to each other; uniting said first end and said second side; forming said second side and said second end to be substantially at right angles to each other; uniting said second side and said second end; forming said second end and said first side to be substantially at right angles to each other; uniting said second end and said first side; flaring outwardly said first side into said first sloping side; flaring outwardly said first end into said first sloping end; uniting said first sloping side and said first sloping end; flaring outwardly said second side into said second sloping side; uniting said first sloping end and said second sloping side; flaring outwardly said second end into said second sloping end; uniting said second sloping side and said second sloping end; uniting said second sloping end and said first sloping side; forming a rim on the outer part of said first sloping side, said first sloping end, said second sloping side and said second sloping end; forming said funnel to be of a unitary, one-piece continuous construction; directing outwardly said rim from said sloping sides and said sloping ends; directing said first walls away from said second walls; forming said first side and said second side to be longer than said first end and said second end; forming said first sloping side and said second sloping side to be longer than said first sloping end and said second sloping end; forming the outer part of said first sloping side and said second sloping to be longer than said first side and said second side; forming the outer part of said first sloping end and said second sloping end to be longer than said first end and said second end.

A funnel made by a process comprising forming first walls to define a first opening; flaring said first walls outwardly to form second walls to define a second opening; said second opening being larger than said first opening; forming said first walls into a first side, a second side, a first end and a second end; forming said first side and said second side to be substantially parallel; forming said first end and said second end to be substantially parallel; forming said first side and said first end to be substantially at right angles to each other; uniting said first side and said first end; forming said first end and said second side to be substantially at right angles to each other; uniting said first end and said second side; forming said second side and said second end to be substantially at right angles to each other; uniting said second side and said second end; forming said second end and said first side to be substantially at right angles to each other; uniting said second end and said first side; flaring outwardly said first side into said first sloping side; flaring outwardly said first end into said first sloping end; uniting said first sloping side and said first sloping end; flaring outwardly said second side into said second sloping side; uniting said first sloping end and said second sloping side; flaring outwardly said second end into said second sloping end; uniting said second sloping side and said second sloping end; uniting said second sloping end and said first sloping side; forming a rim on the outer part of said first sloping side, said first sloping end, said second sloping side and said second sloping end; forming said funnel to be of a unitary, one-piece continuous construction; directing outwardly said rim from said sloping sides and said sloping ends; directing said first walls away from said second walls; forming said first side and said second side to be longer than said first end and said second end; forming said first sloping side and said second sloping side to be longer than said first sloping end and said second sloping end; forming the outer part of said first sloping side and said second sloping being longer than said first side and said second side; forming the outer part of said first sloping end and said second sloping end to be longer than said first end and said second end.

A combination of separated walls for defining a space and a funnel for directing a fluid material to said space and comprising said funnel comprising first walls defining a first opening; said first walls flaring outwardly into second walls to define a second opening; said second opening being larger than said first opening; each of said separated walls comprising an upper part; said funnel resting on and being positioned on said upper of each of said separated walls; said first walls comprising a first side, a second side a first end and a second end; said first side and said second side being substantially parallel; said first end and said second end being substantially parallel; said first side and said first end being substantially at right angles to each other; said first side and said first end being united with each other; said first end and said second side being substantially at right angles to each other; said first end and said second side being united with each other; said second side and said second end being substantially at right angles to each other; said second side and said second end being united with each other; said second end and said first side being substantially at right angles to each other; said second end and said first side being united with each other; said first side flaring outwardly into said first sloping side; said first end flaring outwardly into said first sloping end; said first sloping side and said first sloping end uniting with each other; said second side flaring outwardly into said second sloping side; a rim on the outer part of said first sloping side, said first sloping end, said second sloping side and said second sloping end; said funnel being of a unitary, one-piece continuous construction; said rim being directed outwardly from said sloping sides and said sloping ends; said first walls being directed away from said second walls; said first side and said second side being longer than said first end and said second end; said first sloping side and said second sloping side being longer than said sloping end and said second sloping end; the outer part of said first sloping side and said second sloping side being longer than said first side and said second side; the outer part of said first sloping end and said second sloping end being longer than said first end and said second end.

What I claim is:

1. A funnel for directing the flow of fluid material to a defined space, said funnel comprising:

a. first walls defining a first opening;

b. said first walls flaring outwardly into second walls to define a second opening;

c. said second opening being larger than said first opening;

d. said first walls comprising a first side, a second side, a first end and a second end;

e. said first side and said second side being substantially parallel to each other;

f. said first end and said second end being substantially parallel to each other;

g. said first side and said first end being substantially at right angles to each other;

h. said first side and said first end being united with each other;

i. said first end and said second side being substantially at right angles to each other;

j. said first end and said second side being united with each other;

k. said second side and said second end being substantially at right angles to each other;

l. said second side and said second end being united with each other;

m. said second end and said first side being substantially at right angles to each other;

n. said second end and said first side being united with each other;

o. said first side flaring outwardly into a first sloping side;

p. said first end flaring outwardly into a first sloping end;

q. said first sloping side and said first sloping end uniting with each other;

r. said second side flaring outwardly into a second sloping side;

s. said first sloping end and said second sloping side uniting with each other;

t. said second end flaring outwardly into a second sloping end;

u. said second sloping side and said second sloping end uniting with each other;

v. said second sloping end and said first sloping side uniting with each other;

w. said funnel being of a unitary, one-piece continuous construction; and x. said first end having a recess to allow said fluid material to flow through said first end and through said first opening.

2. A funnel according to claim 1 and comprising:

a. a rim on the outer part of said first sloping side, said first sloping end, said second sloping side and said second sloping end.

3. A funnel according to claim 2 and comprising:

a. said rim being directed outwardly from said sloping sides and said sloping ends; and b. said first walls being directed away from said second walls.

4. A funnel according to claim 3 and comprising:

a. said first side and said second side being longer than said first end and said second end;

b. said first sloping side and said second sloping side being longer than said first sloping end and said second sloping end;

c. the outer part of said first sloping side and said second sloping side being longer than said first side and said second side; and d. the outer part of said first sloping end and said second sloping end being longer than said first end and said second end.

5. A process for making a funnel for directing the flow of a fluid material to a defined space, said process comprising:

a. forming first walls to define a first opening;

b. flaring said first walls outwardly to form second walls to define a second opening;

c. forming said second opening to be larger than said first opening;

d. forming said first walls into a first side, a second side, a first end and a second end;

e. forming said first side and said second side to be substantially parallel to each other;

f. forming said first end and said second end to be substantially parallel to each other;

g. forming said first side and said first end to be substantially at right angles to each other;

h. uniting said first side and said first end;

i. forming said first end and said second side to be substantially at right angles to each other;

j. uniting said first end and said second side;

k. forming said second side and said second end to be substantially at right angles to each other;

l. uniting said second side and said second end;

m. forming said second end and said first side to be substantially at right angles to each other;

n. uniting said second end and said first side;

o. flaring outwardly said first side into a first sloping side;

p. flaring outwardly said first end into a first sloping end;

q. uniting said first sloping side and said first sloping end;

r. flaring outwardly said second side into a second sloping side;

s. uniting said first sloping end and said second sloping side;

t. flaring outwardly said second end into a second sloping end;

u. uniting said second sloping side and said second sloping end;

v. uniting said second sloping end and said first sloping side;

w. forming said funnel to be of a unitary, one-piece continuous construction; and x. forming said first end to have a recess to allow said fluid material to flow through said first end and through said first opening.

6. A process according to claim 5 and comprising:

a. forming a rim on the outer part of said first sloping side, said first sloping end, said second sloping side and said second sloping end.

7. A process according to claim 6 and comprising:

a. directing outwardly said rim from said sloping sides and said sloping ends; and b. directing said first walls away from said second walls.

8. A process according to claim 7 and comprising:

a. forming said first side and said second side to be longer than said first end and said second end;

b. forming said first sloping side and said second sloping side to be longer than said first sloping end and said second sloping end;

c. forming the outer part of said first sloping side and said second sloping to be longer than said first side and said second side; and d. forming the outer part of said first sloping end and said second sloping end to be longer than said first end and said second end.

9. A funnel made by a process comprising:

a. forming first walls to define a first opening;

b. flaring said first walls outwardly to form second walls to define a second opening;

c. said second opening being larger than said first opening;

d. forming said first walls into a first side, a second side, a first end and a second end;

e. forming said first side and said second side to be substantially parallel to each other;

f. forming said first end and said second end to be substantially parallel to each other;

g. forming said first side and said first end to be substantially at right angles to each other;

h. uniting said first side and said first end;

i. forming said first end and said second side to be substantially at right angles to each other;

j. uniting said first end and said second side;

k. forming said second side and said second end to be substantially at right angles to each other;

l. uniting said second side and said second end;

m. forming said second end and said first side to be substantially at right angles to each other;

n. uniting said second end and said first side;

o. flaring outwardly said first side into a first sloping side;

p. flaring outwardly said first end into a first sloping end;

q. uniting said first sloping side and said first sloping end;

r. flaring outwardly said second side into a second sloping side;

s. uniting said first sloping end and said second sloping side;

t. flaring outwardly said second end into said second sloping end;

u. uniting said second sloping side and said second sloping end;

v. uniting said second sloping end and said first sloping side;

w. forming said funnel to be of a unitary, one-piece continuous construction; and x. forming said first end with a recess to allow said fluid material to flow through said first end and through said first opening.

10. A funnel according to claim 9 and comprising:

a. forming a rim on the outer part of said first sloping side, said first sloping end, said second sloping side and said second sloping end.

11. A funnel made by a process according to claim 9 and comprising:

a. directing outwardly said rim from said sloping sides and said sloping ends; and b. directing said first walls away from said second walls.

12. A funnel made by a process according to claim 11 and comprising:

a. forming said first side and said second side to be longer than said first end and said second end;

b. forming said first sloping side and said second sloping side to be longer than said first sloping end and said second sloping end;

c. forming the outer part of said first sloping side and said second sloping being longer than said first side and said second side; and d. forming the outer part of said first sloping end and said second sloping end to be longer than said first end and said second end.

13. A combination of separated walls for defining a space and a funnel for directing a fluid material to said space and comprising:

said funnel comprising:

a. first walls defining a first opening;

b. said first walls flaring outwardly into second walls to define a second opening;

c. said second opening being larger than said first opening;

each of said separated walls comprising:

d. an upper part;

e. said funnel resting on and being positioned on said upper part of each of said separated walls;

f. said first walls comprising a first side, a second side a first end and a second end;

g. said first side and said second side being substantially parallel to each other;

h. said first end and said second end being substantially parallel to each other;

i. said first side and said first end being substantially at right angles to each other;

j. said first side and said first end being united with each other;

k. said first end and said second side being substantially at right angles to each other;

l. said first end and said second side being united with each other;

m. said second side and said second end being substantially at right angles to each other;

n. said second side and said second end being united with each other;

o. said second end and said first side being substantially at right angles to each other;

p. said second end and said first side being united with each other;

q. said first side flaring outwardly into a first sloping side;

r. said first end flaring outwardly into a first sloping end;

s. said first sloping side and said first sloping end uniting with each other;

t. said second side flaring outwardly into a second sloping side;

u. said first sloping end and said second sloping side uniting with each other;

v. said second end flaring outwardly into a second sloping end;

w. said second sloping side and said second sloping end uniting with each other;

x. said second sloping end and said first sloping side uniting with each other;

y. said funnel being of a unitary, one-piece continuous construction; and z. said first end having a recess to allow said fluid material to flow through said first end and through said first opening.

14. A combination according to claim 13 and comprising:

a. a rim on the outer part of said first sloping side, said first sloping end, said second sloping side and said second sloping end.

15. A combination according to claim 13 and wherein said funnel comprises:

a. said rim being directed outwardly from said sloping sides and said sloping ends; and b. said first walls being directed away from said second walls.

16. A combination according to claim 15 and wherein said funnel comprises:

a. said first side and said second side being longer than said first end and said second end;

b. said first sloping side and said second sloping side being longer than said sloping end and said second sloping end;

c. the outer part of said first sloping side and said second sloping side being longer than said first side and said second side; and d. the outer part of said first sloping end and said second sloping end being longer than said first end and said second end.

17. A combination of a form for receiving a fluid material and a funnel for directing said fluid material to said form, and comprising:

said form comprising:

a. a first form wall and a second form wall;

b. said first form wall and said second form wall being spaced apart;

said funnel comprising:

c. first walls defining a first opening;

d. said first walls flaring outwardly into second walls to define a second opening;

e. said second opening being larger than said first opening;

f. said first walls being positioned between said first form wall and said second form wall;

g. said first walls comprising a first side, a second side, a first end and a second end;

h. said first side and said second side being substantially parallel to each other;

i. said first end and said second end being substantially parallel to each other;

j. said first side and said first end being substantially at right angles to each other;

k. said first side and said first end being united with each other;

l. said first end and said second side being substantially at right angles to each other;

m. said first end and said second side being united with each other;

n. said second side and said second end being substantially at right angles to each other;

o. said second side and said second end being united with each other;

p. said second end and said first side being substantially at right angles to each other;

q. said second end and said first side being united with each other;

r. said first side flaring outwardly into a first sloping side;

s. said first end flaring outwardly into a first sloping end;

t. said first sloping side and said first sloping end uniting with each other;

u. said second side flaring outwardly into a second sloping side;

v. said first sloping end and said second sloping side uniting with each other;

w. said second end flaring outwardly into a second sloping end;

x. said second sloping side and said second sloping end uniting with each other;

y. said second sloping end and said first sloping side uniting with each other;

z. said funnel being of a unitary, one-piece continuous construction; and aa. said first end having a recess to allow said fluid material to flow through said first end and through said first opening.

18. A combination according to claim 17 and comprising:

a. a rim on the outer part of said first sloping side, said first sloping end, said second sloping side and said second sloping end.

* * * * *